US006836248B2

(12) United States Patent
Fukushima et al.

(10) Patent No.: US 6,836,248 B2
(45) Date of Patent: Dec. 28, 2004

(54) ANTENNA DEVICE

(75) Inventors: Susumu Fukushima, Osaka (JP); Naoki Yuda, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 2 days.

(21) Appl. No.: 10/276,262

(22) PCT Filed: Mar. 15, 2002

(86) PCT No.: PCT/JP02/02454

§ 371 (c)(1),
(2), (4) Date: Apr. 22, 2003

(87) PCT Pub. No.: WO02/075853

PCT Pub. Date: Sep. 26, 2002

(65) Prior Publication Data

US 2003/0160728 A1 Aug. 28, 2003

(30) Foreign Application Priority Data

Mar. 15, 2001 (JP) ..... 2001-073733

(51) Int. Cl.[7] ..... H01Q 1/38
(52) U.S. Cl. ..... 343/700 MS; 343/846
(58) Field of Search ..... 343/700 MS, 702, 343/767, 829, 846

(56) References Cited

U.S. PATENT DOCUMENTS

| | | | | |
|---|---|---|---|---|
| 5,526,003 A | * | 6/1996 | Ogawa et al. | 343/700 MS |
| 5,591,312 A | | 1/1997 | Smalley | |
| 5,786,793 A | * | 7/1998 | Maeda et al. | 343/700 MS |
| 6,181,281 B1 | * | 1/2001 | Desclos et al. | 343/700 MS |
| 6,187,823 B1 | | 2/2001 | Haddon et al. | |
| 6,459,413 B1 | * | 10/2002 | Tseng et al. | 343/702 |
| 6,573,869 B2 | * | 6/2003 | Moore | 343/702 |
| 6,680,705 B2 | * | 1/2004 | Tan et al. | 343/702 |

FOREIGN PATENT DOCUMENTS

| | | |
|---|---|---|
| EP | 0777295 | 6/1997 |
| JP | 07-14714 | 3/1995 |
| JP | 07-131234 | 5/1995 |
| JP | 09-93031 | 4/1997 |
| JP | 10-093332 | 4/1998 |
| JP | 2000-068736 | 3/2000 |

OTHER PUBLICATIONS

Japanese International Search Report for PCT/JP02/02454, dated Jun. 18, 2002.
English translation of Japanese International Search Report for PCT/JP02/02454, dated Jun. 18, 2002.
Salonen, et al., "New Slot Configurations for Dual–Band Planar Inverted–F Antenna", Microwave and Optical Technology Letters, vol. 28, No. 5, Mar. 5, 2001, pp. 293–298.
Miyauchi, et al., "Tsushinyo Micro–ha Kairo", Denshi Tsushin Gakkai, Oct. 20, 1985, pp. 51–52.

* cited by examiner

*Primary Examiner*—Tho Phan
(74) *Attorney, Agent, or Firm*—RatnerPrestia

(57) ABSTRACT

A small antenna device having a wide frequency band suitable for being built in mobile communications apparatuses. This antenna device includes a planar radiating element (radiating plate) and a grounding plate provided in parallel to and facing the radiating plate. A feeding line is disposed at approximately the end center of the radiating plate, and supplies high-frequency signals. A shorting portion shorts the radiating plate and grounding plate at near the feeding line. A slit is provided at an end face of the radiating plate approximately opposing the feeding line to form two resonators. A coupling level between two resonators is optimized by adjusting the shape or dimensions of this slit, or loading a reactance element or conductive plate on this slit. Accordingly, a small and short antenna with a preferred characteristic is achieved.

29 Claims, 24 Drawing Sheets

ANTENNA DEVICE

THIS APPLICATION IS A U.S. NATIONAL PHASE APPLICATION OF PCT INTERNATIONAL APPLICATION PCT/JP02/02454.

FIELD OF THE INVENTION

The present invention relates to surface-mounted antennas typically used in mobile communications systems such as mobile phones and short-distance wireless communications.

BACKGROUND OF THE INVENTION

Frequencies in the UHF band and microwave band have been used exclusively for mobile communications systems such as mobile phones and short-distance wireless communications systems. Apparatuses used for these systems are required to cover a wide frequency band, be inexpensive, small, light and portable. Accordingly, a wide-band, high-gain, small, light, and inexpensive antenna is desired for these apparatuses.

One example of such antennas is a planar inverted-F antenna, as shown in FIG. 28, which employs a microstrip conductor. The antenna shown in FIG. 28 is a commonly adopted short antenna which is surface-mounted on a circuit board of an apparatus.

In this antenna, radiating element 100 made of plate conductor (hereafter, a planar radiating element is referred to as a radiating plate) and grounding plate 101 are disposed in parallel with a predetermined spacing, as shown in FIG. 28. In general, as shown in FIG. 28, grounding plate 101 is larger than radiating plate 100. A high frequency signal is supplied to a point (hereafter referred to as the feeding point) provided at a predetermined end of radiating plate 100 through feeding line 102. A point near the feeding point and grounding plate 101 are connected on radiating plate 100 by shorting plate 103 so as to ground at high frequencies. The name 'inverted-F antenna' is derived from the shape of this antenna as seen from the side.

The planar inverted-F antenna as configured above has an antenna radiating element on one face of grounding plate 101. Accordingly, the radiating element is seldom blocked by other components in an apparatus when the antenna is built into the apparatus. The planar inverted-F antenna is thus suitable for surface mounting in such apparatuses.

However, the antenna as configured above may have a narrower bandwidth when the spacing between radiating plate 100 and grounding plate 101 or a projected area of radiating plate 100 to grounding plate 101 is made small. These dimensions can thus be reduced by only a limited degree, making it difficult to further downsize and shorten the height of the antenna.

SUMMARY OF THE INVENTION

An object of the present invention is to offer a small and short antenna with a wider frequency band.

An antenna device of the present invention includes:

a radiating plate;

a grounding plate facing the radiating plate;

a feeding line disposed on a side or end of the radiating plate; and a shorting portion which connects a point close to the feeding line and the grounding plate.

In addition, a slit is provided at a side or end at the side approximately opposing the feeding line. This causes two resonators to be formed on the radiating plate. The coupling level between these two resonators and positions of the feeder and shorting portion are adjusted.

The present invention has the following embodiments.

(1) The antenna can be downsized by forming an approximately T-shaped or tongue-shape slit to give each resonator a Stepped Impedance Resonator (SIR) structure.

(2) The antenna can be downsized by extending a part of the slit longer.

(3) The coupling level between two resonators is adjustable over a wider range by providing a conductive coupling plate so as to extend over the slit via an insulating member.

(4) The coupling level between two resonators is adjustable by partially changing the slit width.

(5) The coupling level between two resonators is adjustable by partially changing the size of the coupling plate.

(6) The antenna can be downsized and surface mounting is made feasible by forming the radiating plate and grounding plate respectively on the surface and rear face of the dielectric, magnetic substance, or a mixture of the two.

(7) The antenna radiating efficiency can be increased by providing air to the space between the radiating plate and grounding plate.

(8) The antenna can have a wider bandwidth and be downsized by forming plural independent slits.

(9) A change in the radiation resistance of the antenna can be flexibly matched by adding or forming a reactance element between a part of one or both of the two resonators and the grounding plate.

(10) The coupling level required for widening the antenna frequency band can be readily obtained by adding or forming a reactance element on a part of the slit.

(11) The reactance element is configured with a coupling plate, a comb element, microstrip line, chip capacitor, or chip inductor. This simplifies the antenna structure, and also enables matching large changes in the radiation resistance of the antenna.

(12) The coupling level between resonators is adjustable over a wider range by short-circuiting the coupling plate and at least one of two resonators.

(13) Variations in the antenna characteristics during manufacture can be suppressed by deforming the comb element using a laser or polisher to adjust the capacitance of the element.

(14) The slit is branched to form a rough T-shape about midway. At least one resonator has at least one of i) a capacitance element added to or formed on an area where a high-frequency electric field is dominant; and ii) an inductance element added to or formed on an area where a high-frequency magnetic field is dominant. This reduces the necessary circuit constant of element, resulting in reduction of the element size and loss in the element.

(15) The slit is branched to form a rough T-shape about midway, and at least one of the branched slits is bent approximately perpendicular near the side of the radiating plate toward the starting point of the slit. At least one resonator has at least one of i) a capacitance element added to or formed on an area where a high-frequency electric field is dominant, and ii) an inductance element added to or formed on an area where high-frequency magnetic field is dominant. This reduces the required circuit constant of element, resulting in reduction of the element size and loss in the element.

(16) The radiating plate is divided into two areas: An area where the starting point of the slit is present (first area), and an area where a shorting point or feeding point is present (second area). If the end point of the slit is present in the second area, the capacitance element and inductance element are respectively added to or formed on the first and second areas. This enables reduction of the required circuit constant of element, resulting in reducing the element size and loss in the element.

(17) The radiating plate is divided into two areas: An area where a starting point of the slit is present (first area), and an area where a shorting point or feeding point is present (second area). The slit is extended passing the second area and its end point lies in the first area. In this case, the capacitance element is added to or formed on the second area. This enables reduction of the required circuit constant of element, resulting in reducing the element size and loss in the element.

(18) The slit is branched to the first resonator side and the second resonator side about midway, and each branch is named the first slit and second slit. The radiating plate is also divided into an area where the starting point of the slit is present (first area) and an area where a shorting point or feeding point is present (second area). If the end point of the first slit is present in the second area, the capacitance element and inductance element are respectively added to or formed on the first and second areas in the first resonator. If the second slit is extended passing the second area and its end point is present in the first area, the capacitance element is added to or formed on the second area in the second resonator. This enables reduction of the required circuit constant of element, resulting in reducing the element size and loss in the element.

(19) At least one of the capacitance element and inductance element is added to or formed on at least one of a portion between the slits and a portion between the radiating plate and grounding plate. This achieves the required impedance characteristics for the resonator and the required coupling level between the resonators.

(20) The antenna can be downsized by adopting meander resonators.

BRIEF DESCRIPTION OF THE DRAWINGS

FIG. 2(*b*) shows frequency characteristics of input VSWR of the antenna device in accordance with the first exemplary embodiment of the present invention.

DESCRIPTION OF THE PREFERRED EMBODIMENT

First Exemplary Embodiment

Figure 1:
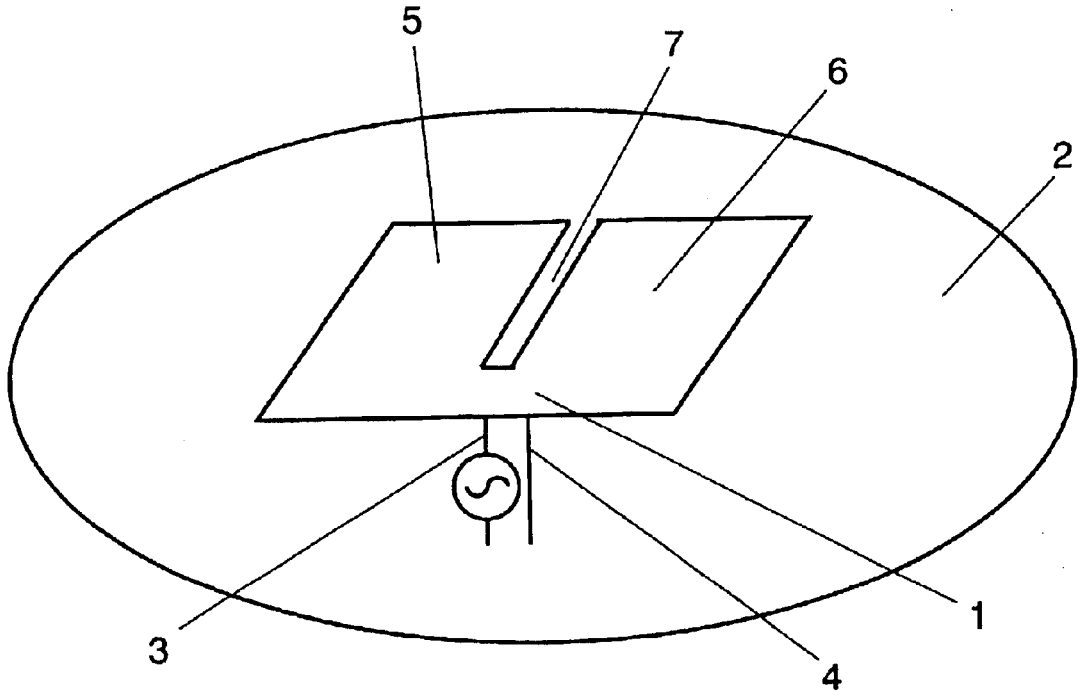
FIG. 1 is a perspective view of an antenna device in accordance with a first exemplary embodiment of the present invention.

FIG. 1 shows an antenna device in a first exemplary embodiment of the present invention.

Radiating plate 1 is disposed facing grounding plate 2 with a predetermined distance. Feeding line 3 is disposed at approximately the side center of radiating plate 1, and supplies a high frequency signal to radiating plate 1.

One end of shorting portion 4 is connected to near feeding line 3 and the other end of shorting portion 4 is connected to grounding plate 2. Shorting portion 4 short-circuits radiating plate 1 at that position.

The start point of a slit 7 is provided on a side of radiating plate 1 roughly opposing feeding line 3. This slit 7 divides radiating plate 1 into two portions, forming resonance radiating elements 5 and 6 (hereafter simply referred to as a resonator). Resonators 5 and 6 are referred to as first and second resonators in the following description.

The antenna device in the first exemplary embodiment is designed to be analogous to the design of a filter circuit. The resonator configuring the filter is generally designed not to emit electromagnetic waves, unlike the antenna radiating element which broadcasts electromagnetic waves. Accordingly, the filter and antenna are not completely equivalent, but in general show a high degree of similarity in behavior such as frequency characteristics. In other words, a method for broadening the filter frequency band is taken into account when broadening the antenna frequency band.

Figure 22:
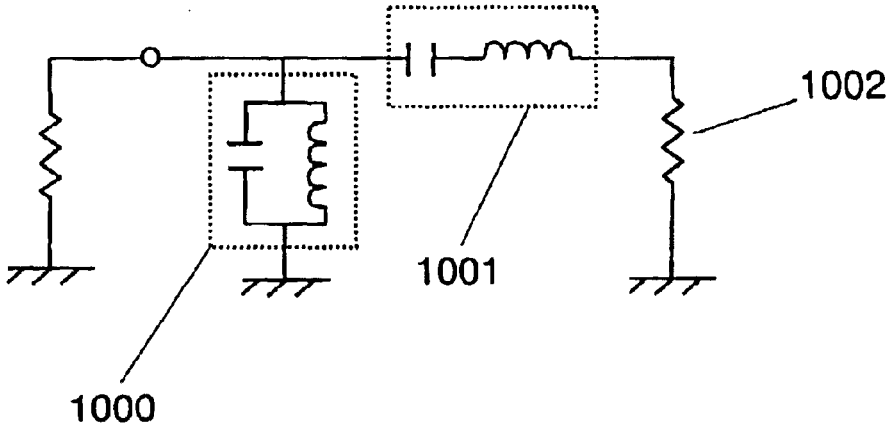
FIG. 22 is a circuit diagram of a two-step ladder band pas filter.

FIG. 22 is a circuit diagram of a two-step ladder band pass filter.

Here, resonator 1001 is connected in series and resonator 1000 is connected in parallel to load resistance 1002.

Figure 23:
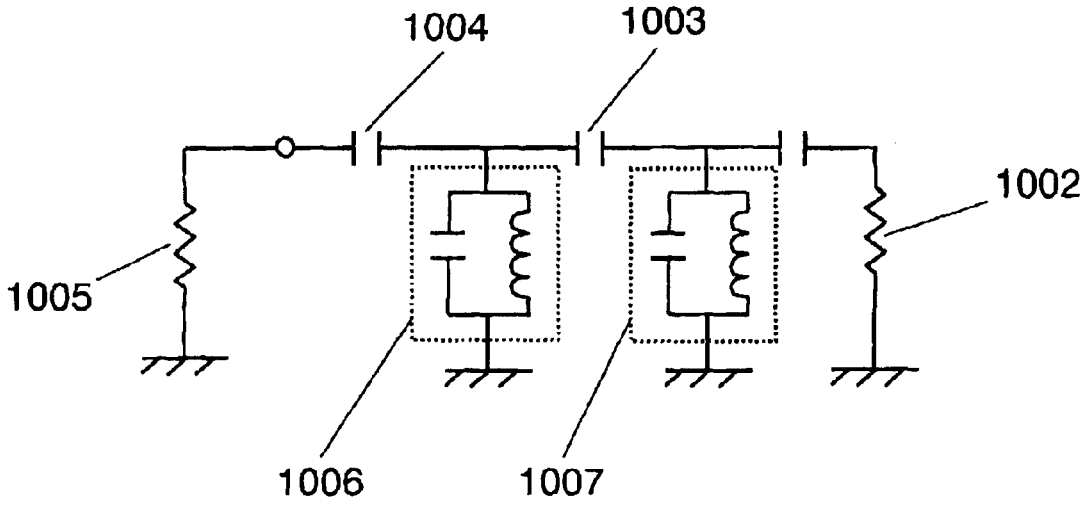
FIG. 23 is a circuit diagram of a parallel tunable two-step ladder band pass filter.

FIG. 23 shows a circuit in which the above filter is equivalently transformed to a parallel tunable band pass filter.

In both Figures, load resistance 1002 corresponds to the antenna radiation resistance. An advantage of the parallel tunable band pass filter in FIG. 23 is that the resonance length can be made to ¼ wavelength when the resonator is configured with a distributed constant line. This enables the reduction of filter dimensions.

If the resonator which has the same system as the ¼ wavelength resonator of the filter is applicable to the radiating element of the antenna, a design method identical to that for broadening the pass band of the filter can be used for the antenna. In addition, the antenna can be downsized.

If resonators 1006 and 1007 in FIG. 23 are virtually considered as radiating elements of the antenna, input signals are emitted from each resonator to outside. Accordingly, a radiation resistance is added to each resonator with respect to an equivalent circuit. These radiation resistances, although not precisely determined, can all be replaced with load resistance 1002 in FIG. 23.

On the other hand, resonators 1006 and 1007 in FIG. 23 correspond to first resonator 5 and second resonator 6 in FIG. 1.

Capacitor 1003 in FIG. 23 corresponds to a capacitor which couples resonators 5 and 6 by slit 7 in FIG. 1, and capacitor 1004 in FIG. 23 corresponds to a capacitor having a capacitance related to distance "d" between feeding line 3 and shorting portion 4 in FIG. 1.

Resistance 1005 represents the internal resistance of a signal source connected to the antenna.

As described above, a method for broadening the pass band of the BPF circuit in FIG. 23 similar to the antenna structure is thus used for broadening the frequency band of the antenna device in this exemplary embodiment.

Figure 24:
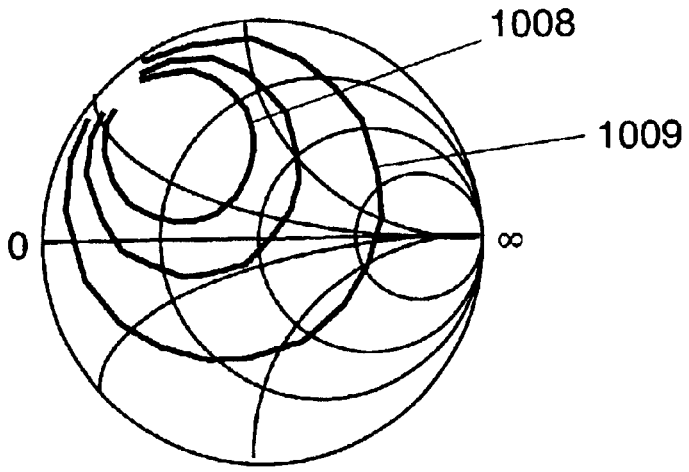
FIG. 24 shows antenna input impedance characteristics when a distance between a shorting portion and feeding portion is changed.

The input impedance of the filter is adjustable to match 50Ω by selecting an appropriate capacitance for capacitor 1004 in FIG. 23. FIG. 24 shows the results of measuring the frequency characteristic of the antenna input impedance, which correspond to the capacitance of capacitor 1004, when distance "d" between feeding line 3 and shorting portion 4 is changed.

As shown in FIG. 24, the frequency characteristic of the input impedance generate a circle on the Smith Chart. It is apparent from FIG. 24 that this circle shrinks, as shown by reference numeral 1008, by reducing distance "d", thereby reducing the antenna input impedance.

On the other hand, this circle expands, as shown by 1009 in FIG. 24, when distance "d" is increased. In other words, the antenna input impedance can be set to be close to 50Ω by adjusting distance "d".

Figure 25:
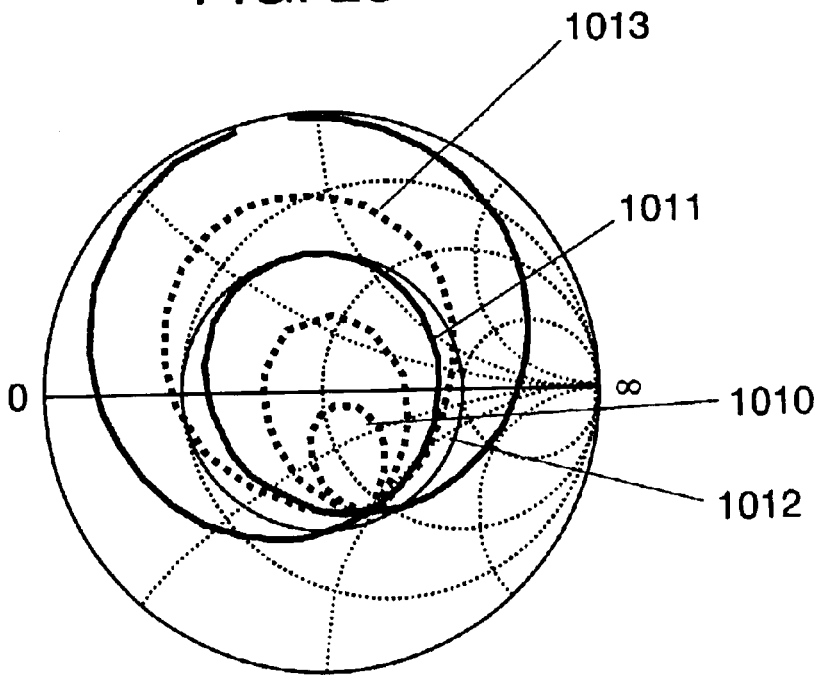
FIG. 25 shows antenna input impedance characteristics when a distance between resonators is changed.

The filter pass-band width can be broadened by selecting an appropriate capacitance for capacitor 1003 in FIG. 23. FIG. 25 shows the results of measuring the frequency characteristic of the antenna input impedance when width "w" of slit 7, corresponding to the capacitance of capacitor 1003, is changed.

The frequency characteristic of the antenna input impedance draws a trace including multiple circles as shown in FIG. 25 when the slit width is changed in an appropriate range and when the shape and dimensions of resonators 5 and 6 are appropriately specified. This is similar to the frequency characteristic obtained by changing the coupling level between resonators in the filter.

The frequency characteristic of the antenna input impedance in the first exemplary embodiment thus becomes as described below.

When the width of slit 7 in FIG. 1 changes, the trace of frequency characteristic of the antenna input impedance is changeable, as shown by circles 1010 and 1013 in the dotted line in FIG. 25.

By optimizing the width of slit 7 in FIG. 1 using this characteristic, a trace for frequency characteristic of the input impedance showing the maximum size in a desired VSWR circle 1012 (a circle representing VSWR=3 in FIG. 25) can be selected. This enables the design of an antenna with extremely wide bandwidth.

To achieve good impedance characteristic 1011, as shown in FIG. 25, readily, the antenna shape is designed so as to make the frequency characteristic of resonators 5 and 6 in FIG. 1 almost the same, i.e., by giving approximately the same shape to resonators 5 and 6.

Figure 2A:
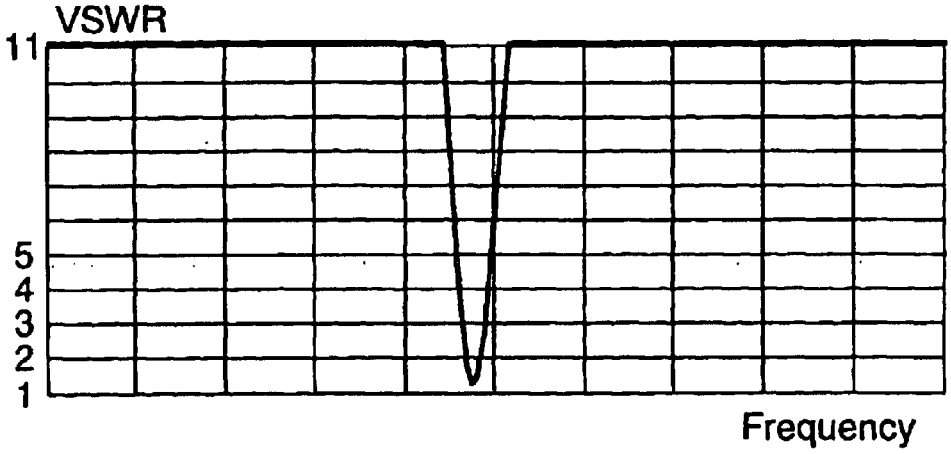
FIG. 2(*a*) shows frequency characteristics of input VWSR of a conventional antenna device.
Figure 2B:
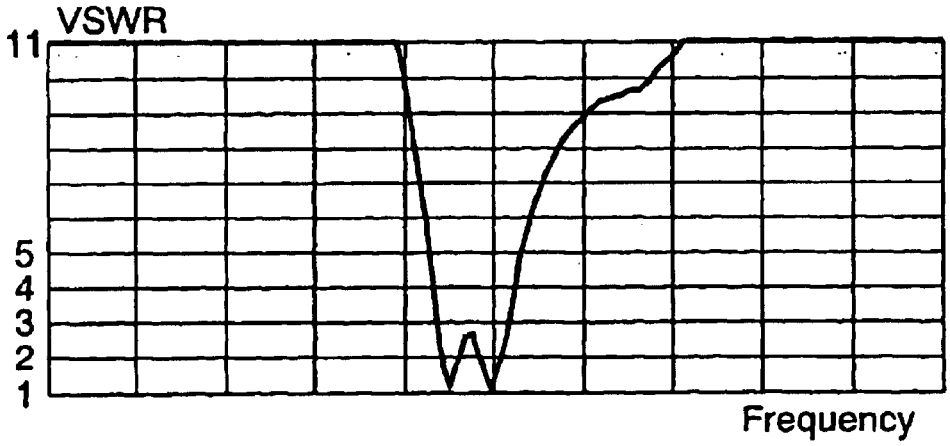

FIG. 2(*a*) shows the VSWR frequency characteristic of the planar inverted-F antenna described in the prior art, and FIG. 2(*b*) shows the VSWR frequency characteristic of the antenna device in this exemplary embodiment.

If the frequency range satisfying VSWR<3 is defined as the antenna bandwidth, the antenna device in the first exemplary embodiment has approximately triple the bandwidth of the prior art.

The antenna in this exemplary embodiment has one band. However, it is possible to design an antenna having dual bands by adjusting the coupling level of resonators 5 and 6.

Second Exemplary Embodiment

Figure 3:
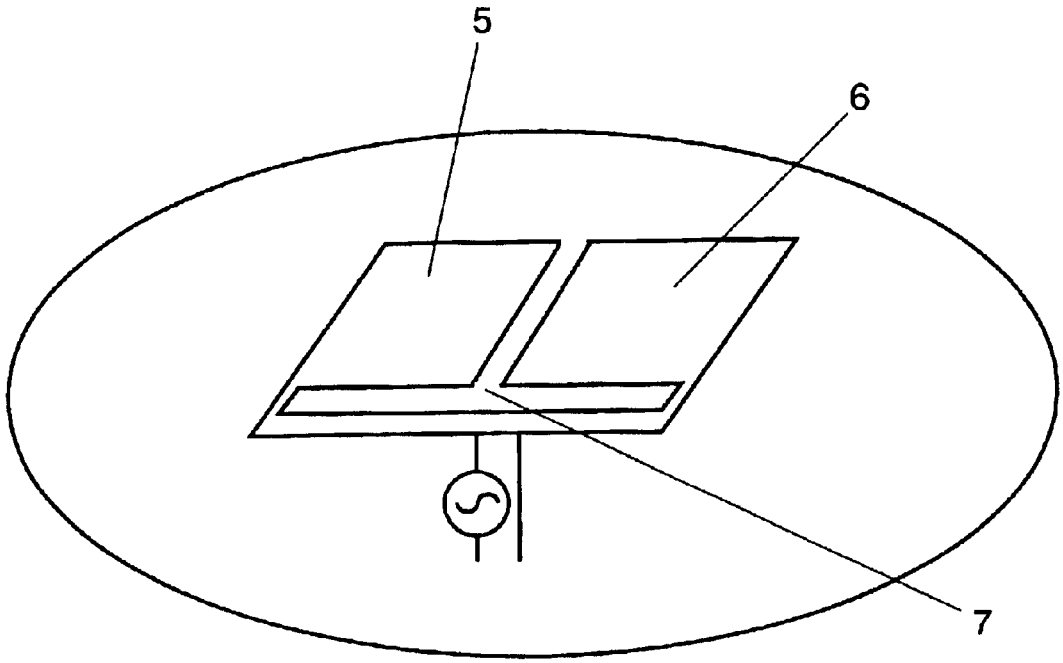
FIG. 3 is a perspective view of an antenna device in accordance with a second exemplary embodiment of the present invention.

FIG. 3 shows an antenna device in a second exemplary embodiment of the present invention.

The shape of resonators 5 and 6 is changed from Uniform Impedance Resonator (UIR) shown in FIG. 1 to Stepped Impedance Resonator (SIR) by adopting a roughly T-shaped slit 7. Compared to UIR, which has a fixed resonator width, the resonator length can be shortened in SIR by changing the resonator width in the middle. Consequently, the antenna size can be reduced. Experimental evidence shows that the antenna size can be reduced by about half by adopting the SIR shape for the resonator.

Third Exemplary Embodiment

Figure 4:
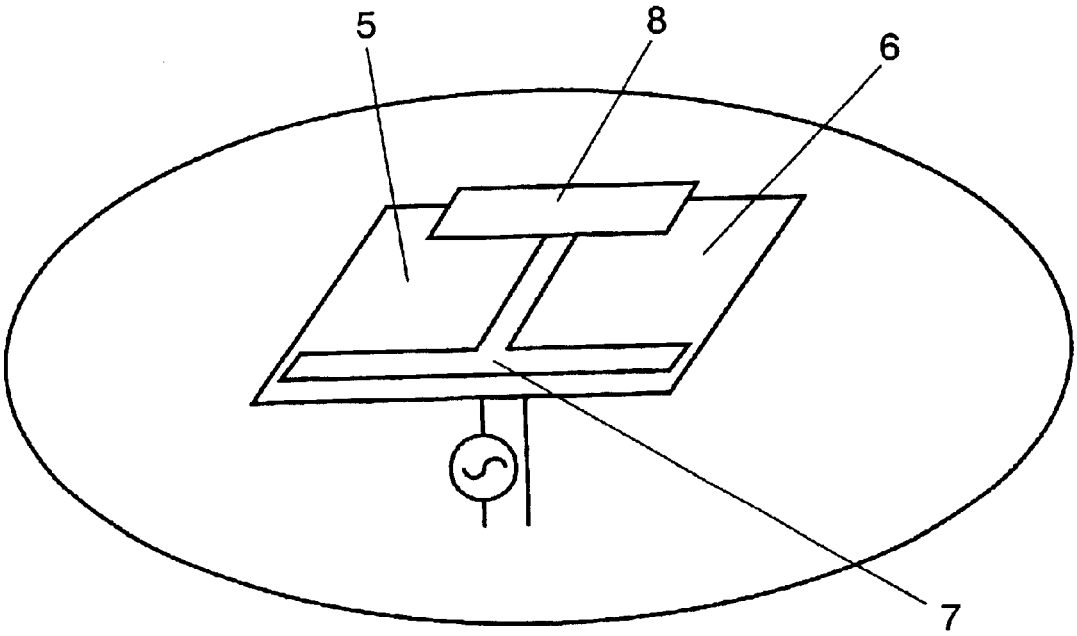
FIG. 4 is a perspective view of an antenna device in accordance with a third exemplary embodiment of the present invention.

FIG. 4 shows an antenna device in a third exemplary embodiment of the present invention.

Coupling plate 8 is disposed on the top face of resonators 5 and 6 across slit 7. However, an insulating material is provided between coupling plate 8 and slit 7. The third exemplary embodiment makes it possible to adjust the coupling level between resonators 5 and 6 by changing the position at which coupling plate 8 is disposed.

In addition, the coupling level between resonators 5 and 6 can be made greater by narrowing the distance between coupling plate 8 and at least one of resonator 5 and resonator 6. Accordingly, the frequency characteristics of the antenna input impedance in FIG. 25 are adjustable by changing the position of the coupling plate or the distance between the coupling plate and resonator.

Fourth Exemplary Embodiment

Figure 5:
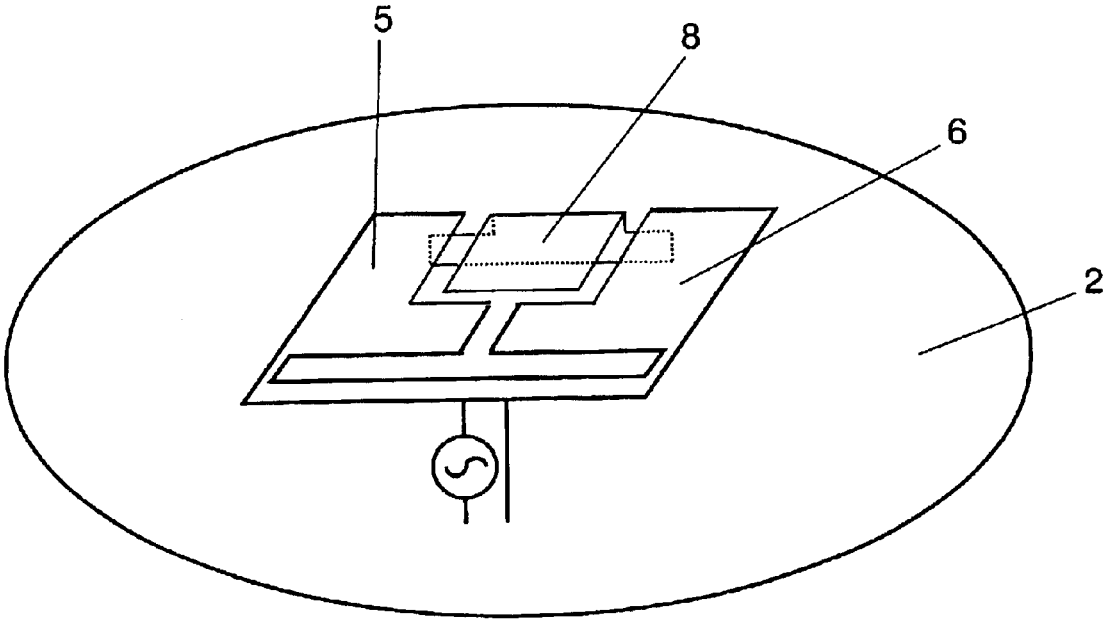
FIG. 5 is a perspective view of an antenna device in accordance with a fourth exemplary embodiment of the present invention.

FIG. 5 shows an antenna device in a fourth exemplary embodiment of the present invention.

A coupling plate is disposed on the same face as radiating plate 1 for achieving an antenna structure that is simple to mass-produce. As shown in FIG. 5, a slit is extended to a side face of the antenna device to adjust the coupling level of resonators 5 and 6.

Fifth Exemplary Embodiment

Figure 6:
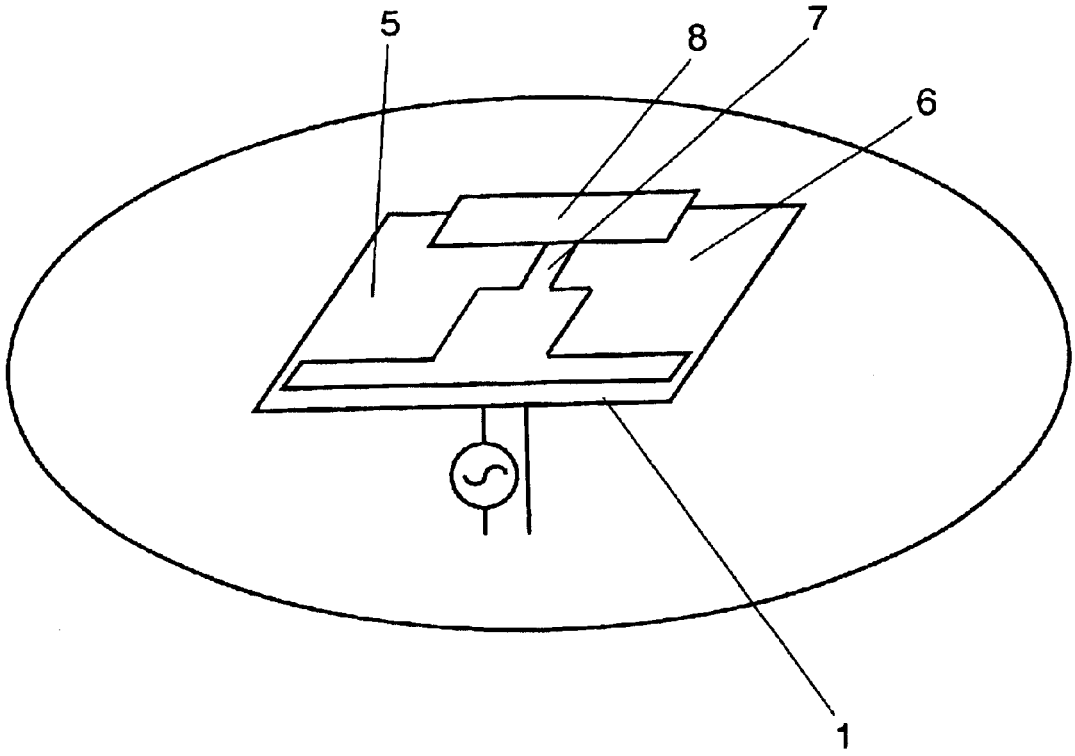
FIG. 6 is a perspective view of an antenna device in accordance with a fifth exemplary embodiment of the present invention.

FIG. 6 shows an antenna device in a fifth exemplary embodiment of the present invention. The coupling level between the resonators 5 and 6 is changeable by partially changing the width of slit 7.

Sixth Exemplary Embodiment

Figure 7:
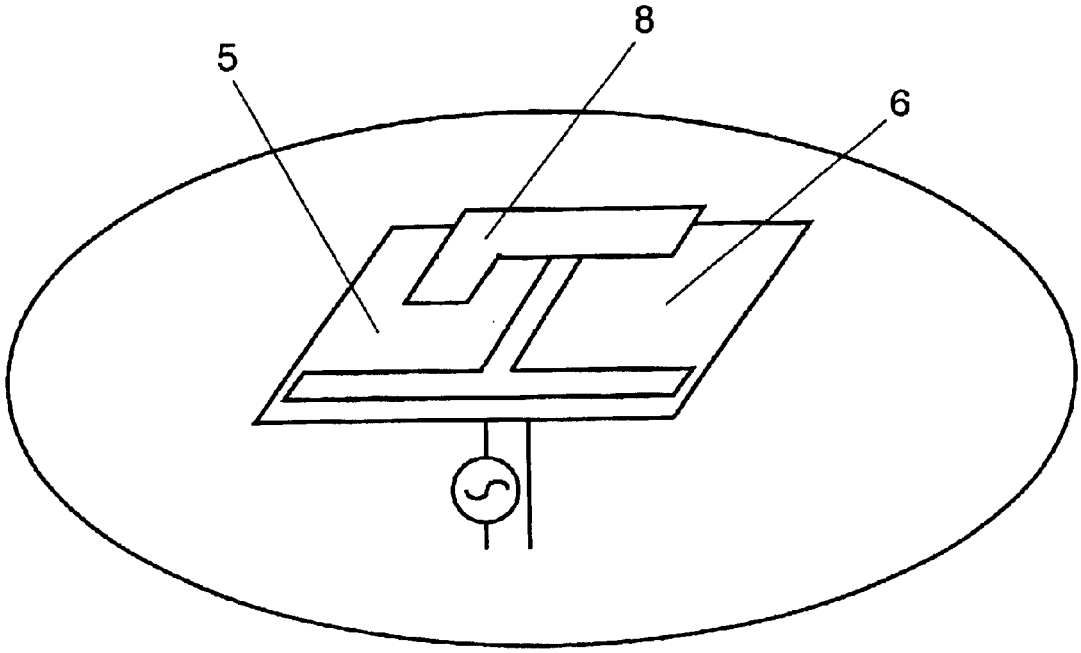
FIG. 7 is a perspective view of an antenna device in accordance with a sixth exemplary embodiment of the present invention.

FIG. 7 shows an antenna device in a sixth exemplary embodiment.

This antenna device has a partially modified coupling plate 8 disposed as in the third exemplary embodiment. The coupling level between resonator 5 and coupling plate 8 can be changed. As a result, the characteristic of the antenna device is adjustable.

Seventh Exemplary Embodiment

Figure 8:
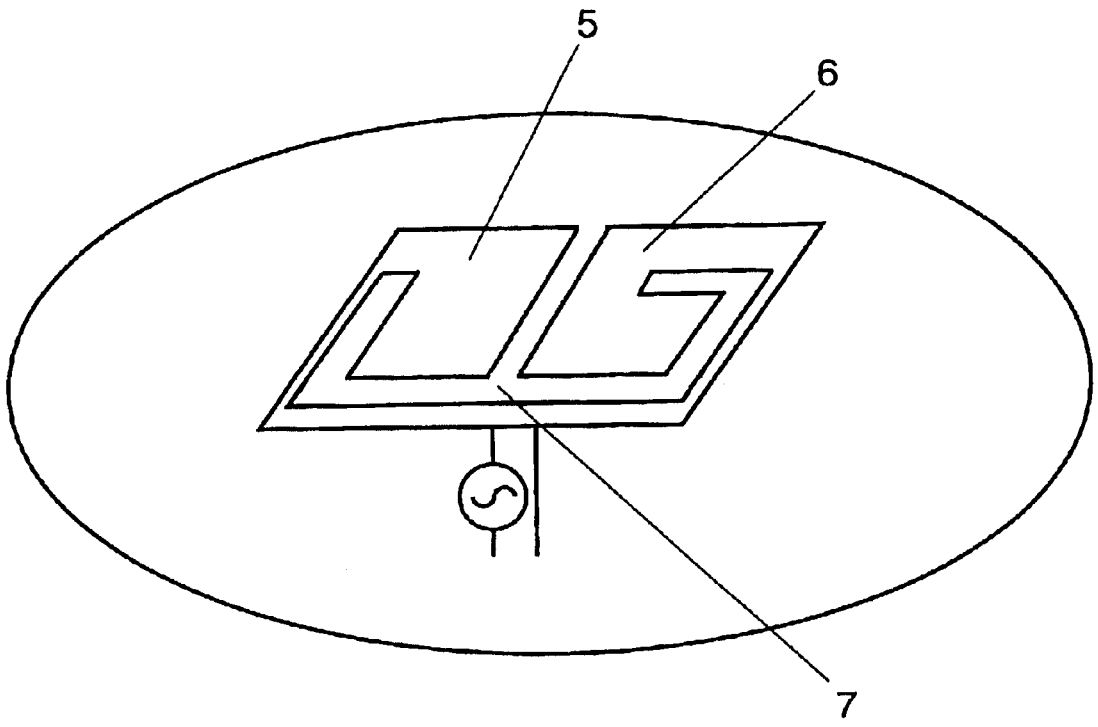
FIG. 8 is a perspective view of an antenna device in accordance with a seventh exemplary embodiment of the present invention.

FIG. 8 shows an antenna device in a seventh exemplary embodiment of the present invention.

As shown in FIG. 8, slit 7 is progressively extended, and resonators 5 and 6 form a tongue shape. This allows a low resonance frequency to be designed for resonators 5 and 6. Consequently, the antenna can be downsized.

Figure 26:
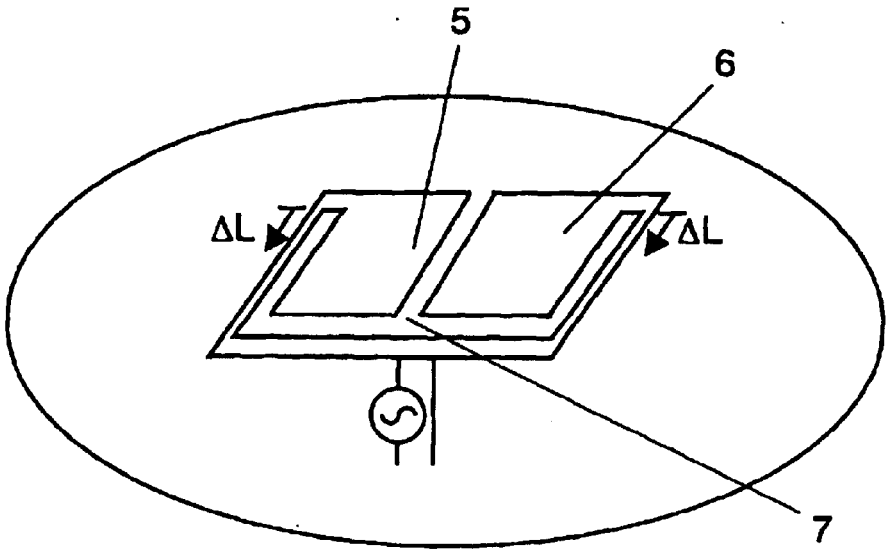
FIG. 26 is a perspective view of the antenna device of the present invention used for measuring characteristics shown in FIG. 27.
Figure 27:
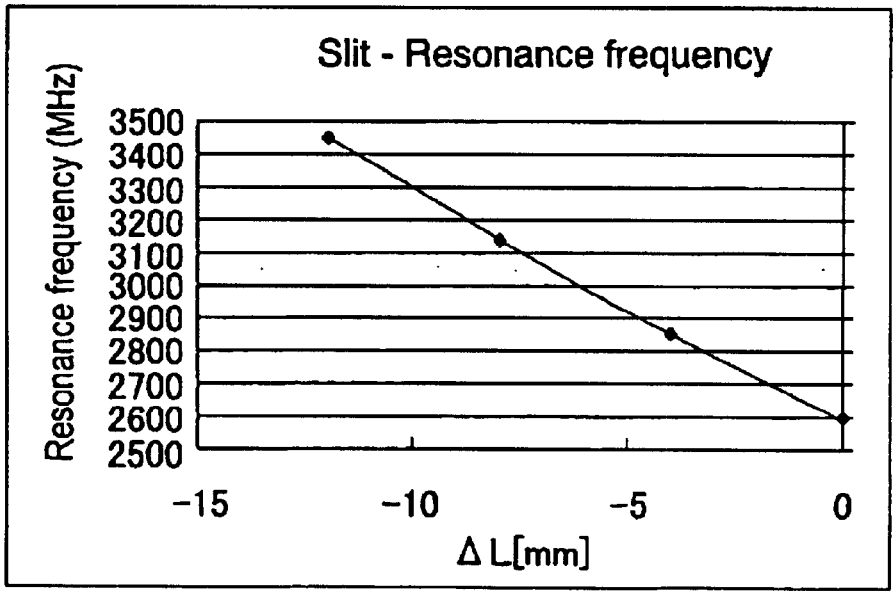
FIG. 27 shows changes in resonance frequency when a slit length is changed.
Figure 28:
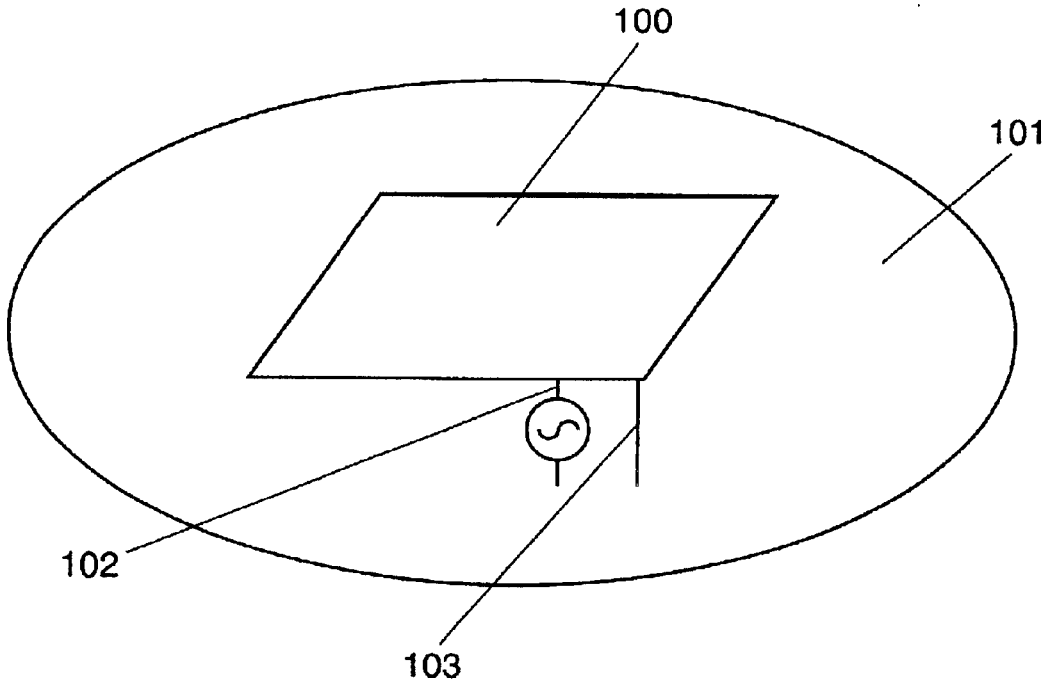
FIG. 28 PRIOR ART
FIG. 28 is a perspective view of the conventional antenna device.

FIG. 27 shows changes in the resonance frequency by changing the length of slit 7 for $\Delta L$ mm in the antenna device in FIG. 26, when the length of slit 7 in both resonators is the same. It is apparent from the Figure that the resonance frequency of the antenna changes for about 70 MHz when the length of slit 7 changes for 1 mm.

Eighth Exemplary Embodiment

Figure 9A:
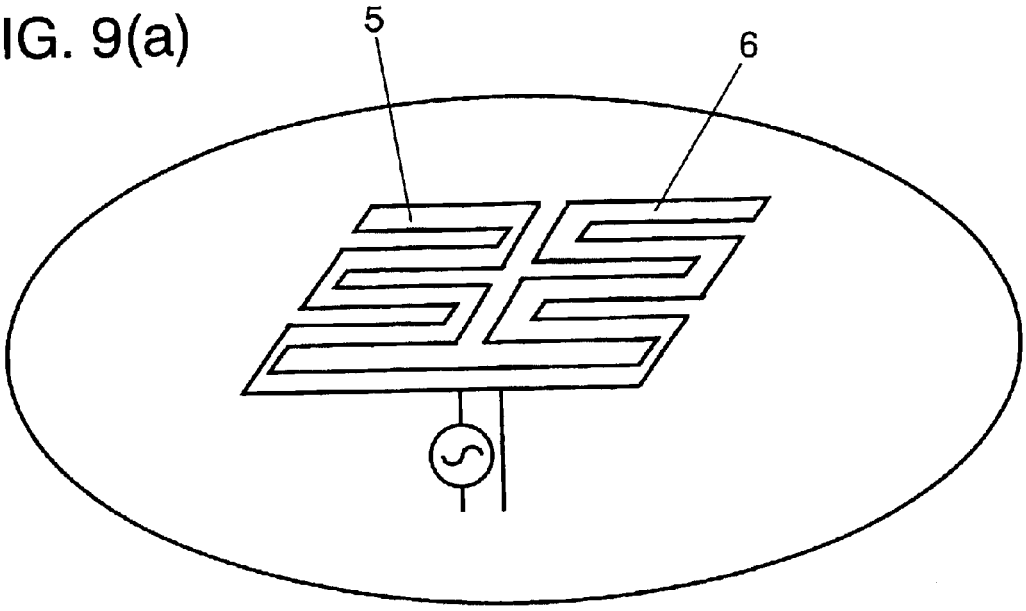
FIGS. 9(*a*) and 9(*b*) are perspective views of an antenna device in accordance with an eighth exemplary embodiment of the present invention.
Figure 9:
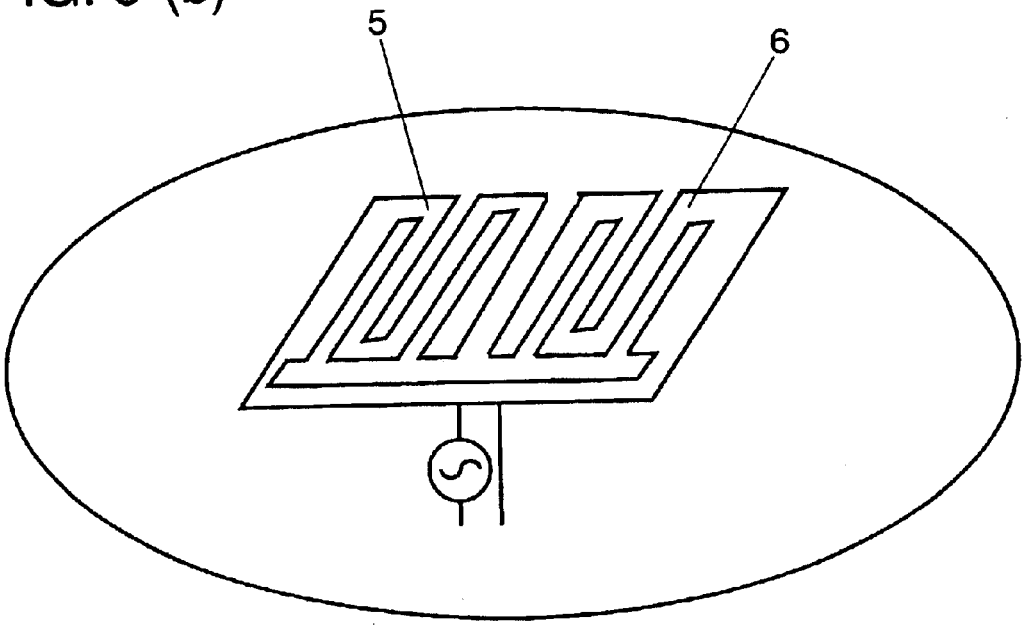

FIGS. 9(*a*) and 9(*b*) show an antenna device in an eighth exemplary embodiment of the present invention.

Resonators 5 and 6 are configured with a meander conductive plate. This allows to design a lower resonance frequency for each resonator. Consequently, the antenna can be downsized. The use of a helical or spiral resonator for each of resonators 5 and 6 can also achieve the same results.

Ninth Exemplary Embodiment

Figure 10:
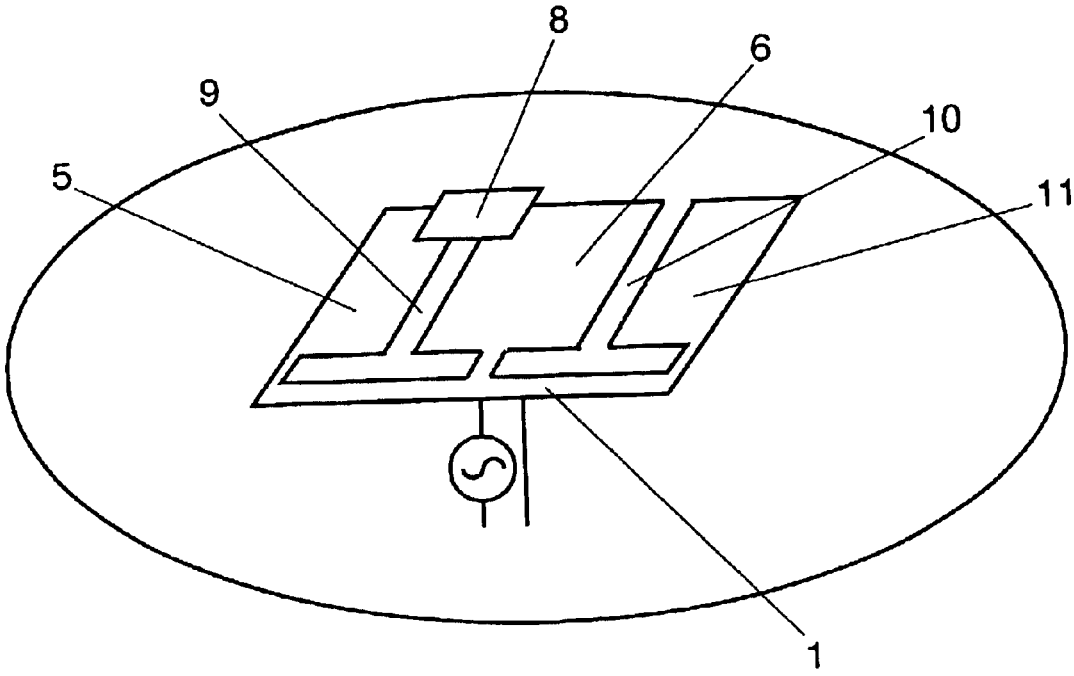
FIG. 10 is a perspective view of an antenna device in accordance with a ninth exemplary embodiment of the present invention.

FIG. 10 shows an antenna device in a ninth exemplary embodiment of the present invention.

As shown in the Figure, two slits 9 and 10 are provided on radiating plate 1 to form three resonators 5, 6, and 11. A coupling level between resonators is adjustable by changing the width of coupling plate 8, and slits 9 and 10. Consequently, a wide bandwidth antenna characteristic is achieved.

Tenth Exemplary Embodiment

Figure 11:
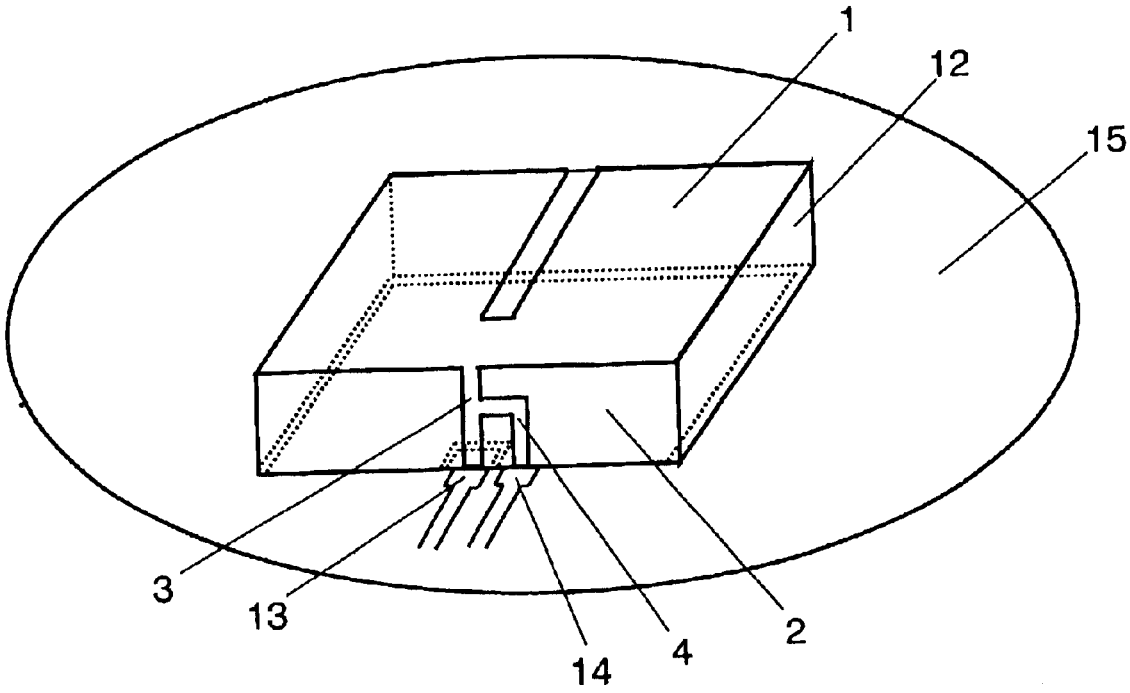
FIG. 11 is a perspective view of an antenna device in accordance with a tenth exemplary embodiment of the present invention.

FIG. 11 shows an antenna device in a tenth exemplary embodiment of the present invention.

Radiating plate 1 is formed on the top face of dielectric 12 and grounding plate 2 is formed on the bottom face of dielectric 12. Line 3 and line 4 as a shorting portion are formed on the side face of dielectric 12. Then, these lines are electrically coupled to feeding land 13 and shorting land 14 provided on board 15. Here, grounding plate 2 and board 15 are bonded and in the same potential at high frequency. This structure makes line 3 a part of radiating plate 1. Accordingly, this antenna device is equivalent to the antenna shown in FIG. 1, thereby achieving the same operations as that of the antenna in FIG. 1.

In this exemplary embodiment, dielectric 12 may be replaced with a magnetic substance for the antenna device to operate as an antenna.

Furthermore, dielectric 12 may be replaced with a mixture of dielectric and magnetic substance for the antenna device to operate as an antenna.

Eleventh Exemplary Embodiment

Figure 12:
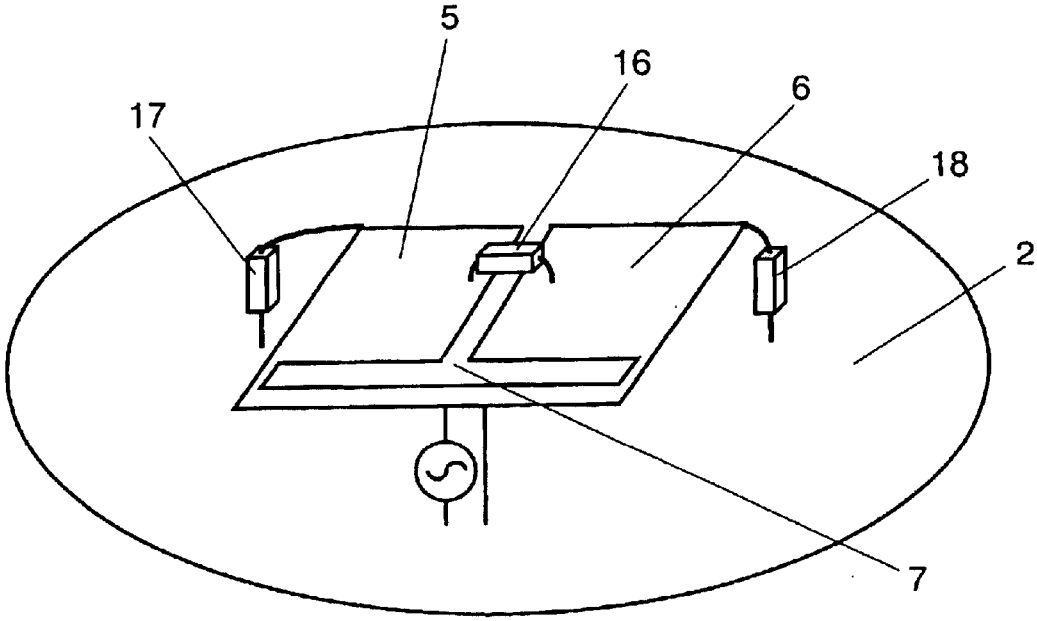
FIG. 12 is a perspective view of an antenna device in accordance with an eleventh exemplary embodiment of the present invention.

FIG. 12 shows an antenna device in an eleventh exemplary embodiment of the present invention.

A required coupling level between resonators 5 and 6 is achieved by adjusting the width of slit 7 or adding first reactance element 16. This achieves the coupling level which cannot be realized just by the shape of slit 7. In addition, second reactance element 17 is added between resonator 5 and grounding plate 2, and third reactance element 18 is added between resonator 6 and grounding plate 2. This enables the adjustment of the Q value in addition to the resonance frequency of each resonator, thereby readily realizing a wide-band antenna characteristic.

Twelfth Exemplary Embodiment

Figure 14:
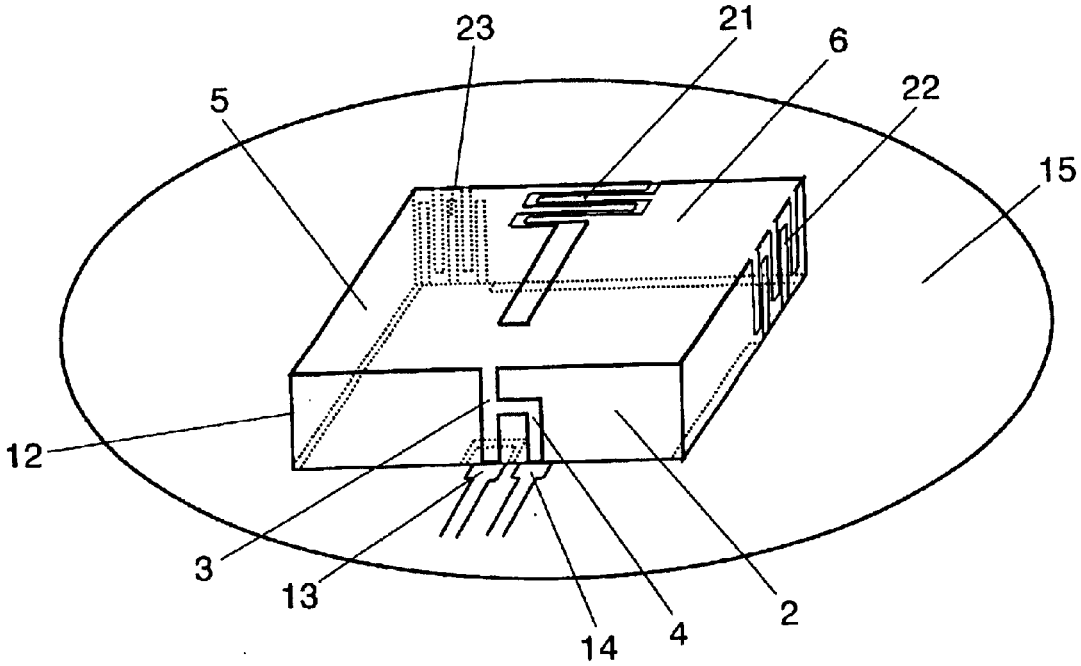
FIG. 14 is a perspective view of an antenna device in accordance with a twelfth exemplary embodiment of the present invention.

FIG. 14 shows an antenna device in a twelfth exemplary embodiment of the present invention.

A required coupling level between resonators 5 and 6 is achieved by forming first comb capacitor 21. In the same way, second comb capacitor 22 is formed between resonator 5 and grounding plate 2, and third comb capacitor 23 is formed between resonator 6 and grounding plate 2. This structure readily realizes a wide-band antenna characteristic easily.

Figure 13:
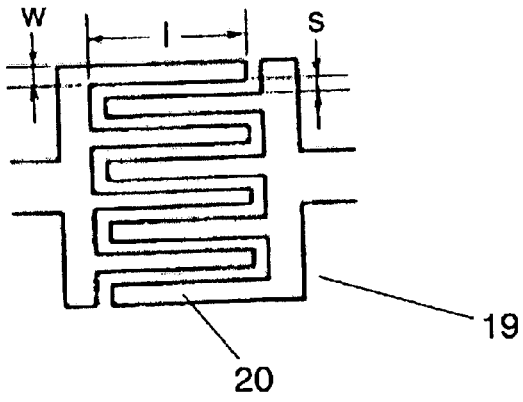
FIG. 13 is an appearance of a comb element.

FIG. 13 shows an example of a comb capacitor.

Capacitance of comb capacitor 21 is determined by dimensions of comb capacitor 21, tooth length 1, gap s between teeth, tooth width w, and relative dielectric constant.

The comb teeth of the comb capacitor shown in FIG. 13 are formed of straight elements, but the same effect is achievable also with curved or inflected teeth.

Tooth length l is adjustable by the laser or polisher to manufacture an antenna with less variations in the characteristic.

Thirteenth Exemplary Embodiment

Figure 15:
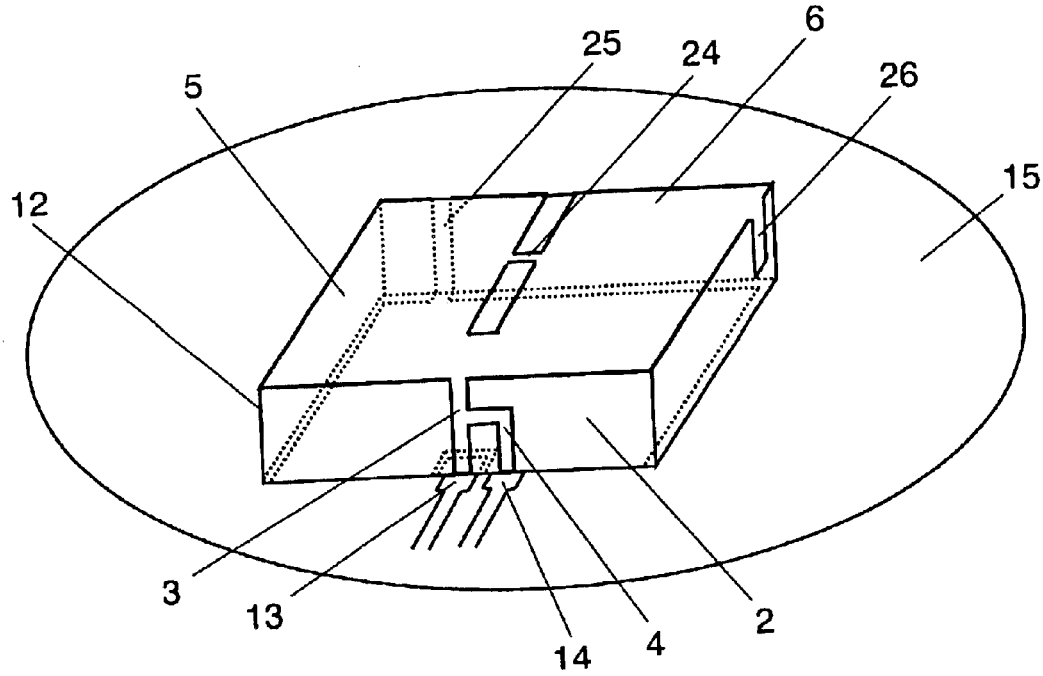
FIG. 15 is a perspective view of an antenna device in accordance with a thirteenth exemplary embodiment of the present invention.

FIG. 15 shows an antenna device in a thirteenth exemplary embodiment of the present invention.

In this antenna device, a coupling level between resonators 5 and 6 is adjustable by changing the length and width of first microstrip line 24. Impedance of resonator 5 is adjusted by adding second microstrip line 25 between an end of resonator 5 and grounding plate 2. In addition, microstrip line with an open end 26 (open stub) is added to an end of resonator 6. Impedance of resonator 6 is adjustable by changing the length and width of this microstrip line 26. Consequently, an antenna device having a wide-band antenna characteristic is readily realized.

Fourteenth Exemplary Embodiment

Figure 16:
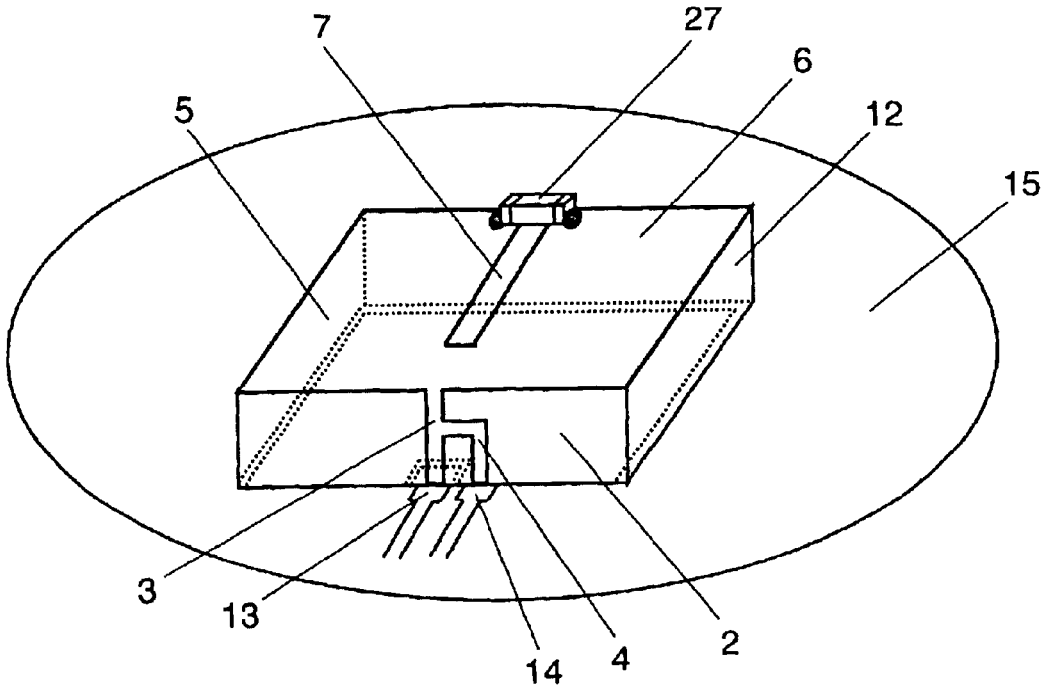
FIG. 16 is a perspective view of an antenna device in accordance with a fourteenth exemplary embodiment of the present invention.

FIG. 16 shows an antenna device in a fourteenth exemplary embodiment of the present invention.

In this antenna device, chip component 27 is mounted between resonators 5 and 6 as shown in the Figure. This enables to add or form reactance with extremely large circuit constant of element between resonators, if required, for achieving a wide-band antenna characteristic. A coupling level between resonators is also adjustable by changing a mounting position of the chip component. In the practical antenna design, it is more efficient and also effective to change reactance and mounting position of the chip component for achieving the required coupling level between the resonators than to adjust the width of slit 7.

Fifteenth Exemplary Embodiment

Figure 17A:
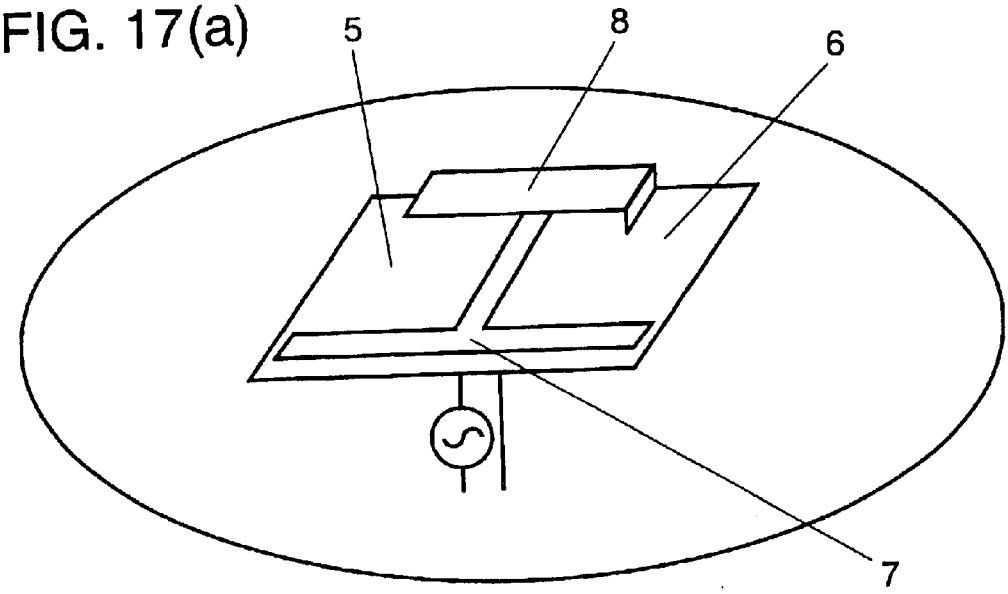
FIGS. 17(*a*) and 17(*b*) are perspective views of an antenna device in accordance with a fifteenth exemplary embodiment of the present invention.
Figure 17:
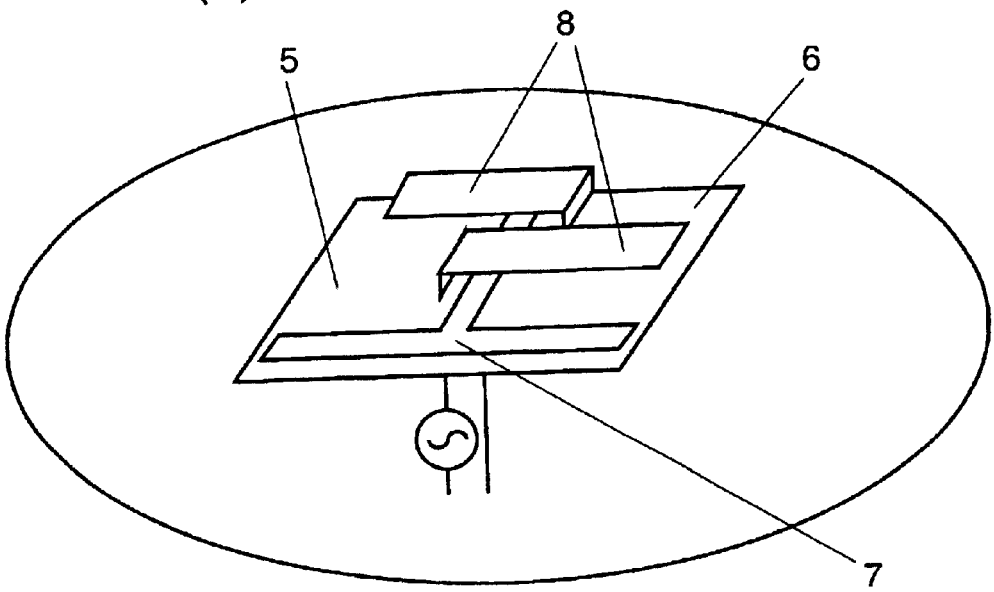

FIG. 17(*a*) and FIG. 17(*b*) show an antenna device in a fifteenth exemplary embodiment of the present invention.

An effective length of the resonator can be made longer by shorting a point near an end of resonator 5 or 6 and one end of coupling plate 8. This enables the downsizing of the antenna.

Sixteenth Exemplary Embodiment

Figure 18:
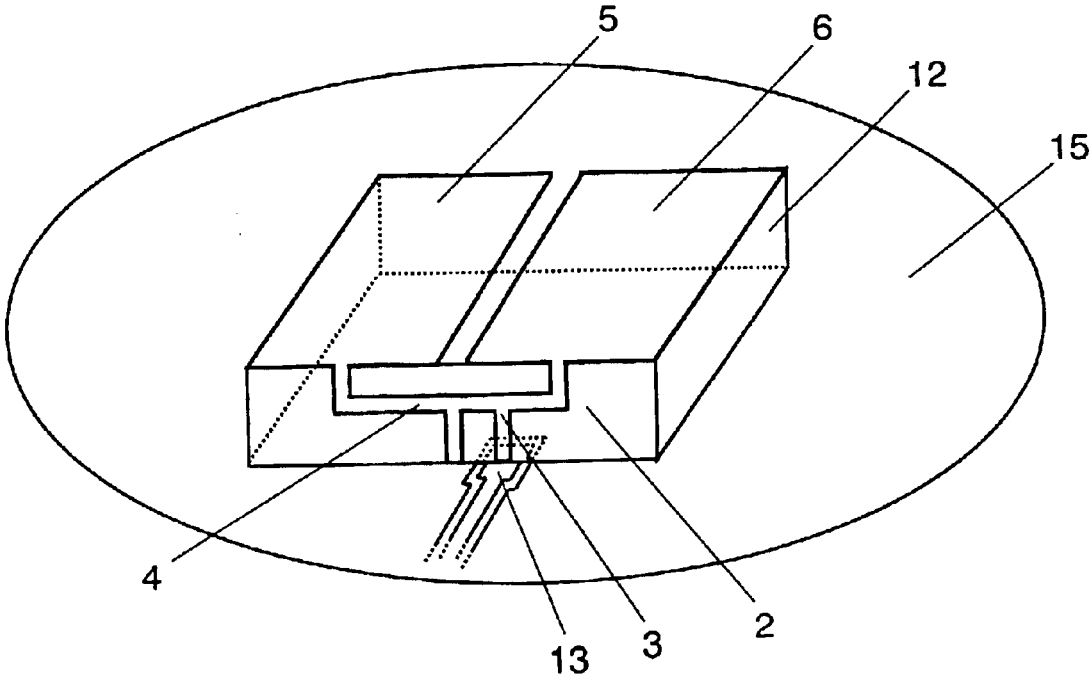
FIG. 18 is a perspective view of an antenna device in accordance with a sixteenth exemplary embodiment of the present invention.

FIG. 18 shows an antenna device in a sixteenth exemplary embodiment of the present invention.

In this embodiment, resonators 5 and 6 are disposed on the surface of dielectric 12. Shorting portion 4 having a narrower line width than that of resonators 5 and 6 is disposed on an end face of the dielectric. The end of each resonator and one end of shorting portion 4 are connected. This configuration allows the end face of dielectric 12 to be used also as a resonator, thereby achieving a longer effective length for the resonator. Furthermore, different line widths for shorting portion 4, and resonators 5 and 6 form a SIR resonator. Accordingly, the antenna device can be downsized.

Seventeenth Exemplary Embodiment

Figure 19:
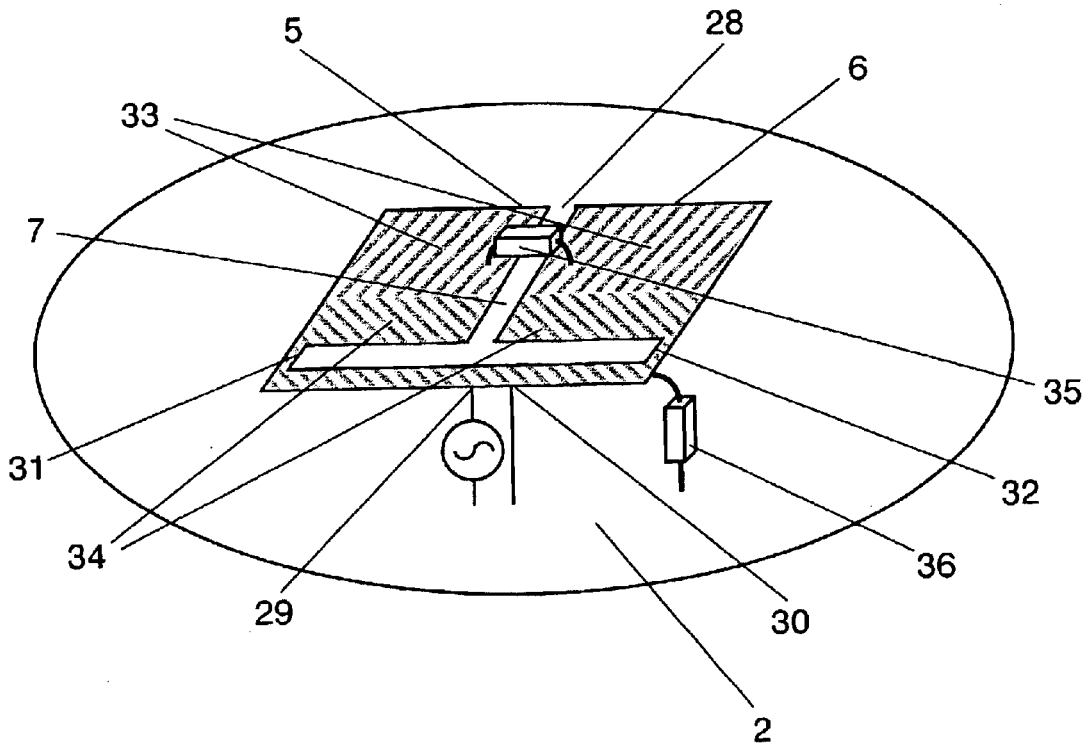
FIG. 19 is a perspective view of an antenna device in accordance with a seventeenth exemplary embodiment of the present invention.

FIG. 19 shows an antenna device in a seventeenth exemplary embodiment of the present invention.

In this embodiment, slit 7 provided on the radiating plate is branched to a T-shape about midway to form first and second slits. The first and second slits have end points 31 and 32 near an end of the radiating plate. The radiating plate is divided into two areas by the perpendicular bisector to the line from start point 28 of slit 7 to feeding contact point 29 on the radiating plate. These areas where start point 28 and feeding contact point 29 lie are called first area 33 and second area 34. Shorting portion contacts radiating plate 2 at shorting contact point 30.

In FIG. 19, if end points 31 of the first slit and end point 32 of the second slit are located in second area 34, a high-frequency potential of the radiating plate against grounding plate 2 is higher in first area 33 than in second area 34. Accordingly, a preferred antenna characteristic is achievable with further smaller capacitance by loading capacitance element 35 in first area 33. Moreover, a preferred antenna characteristic is achievable with further smaller inductance by loading inductance element 36 in second area 34 where a high-frequency current on the radiating plate is larger.

Eighteenth Exemplary Embodiment

Figure 20:
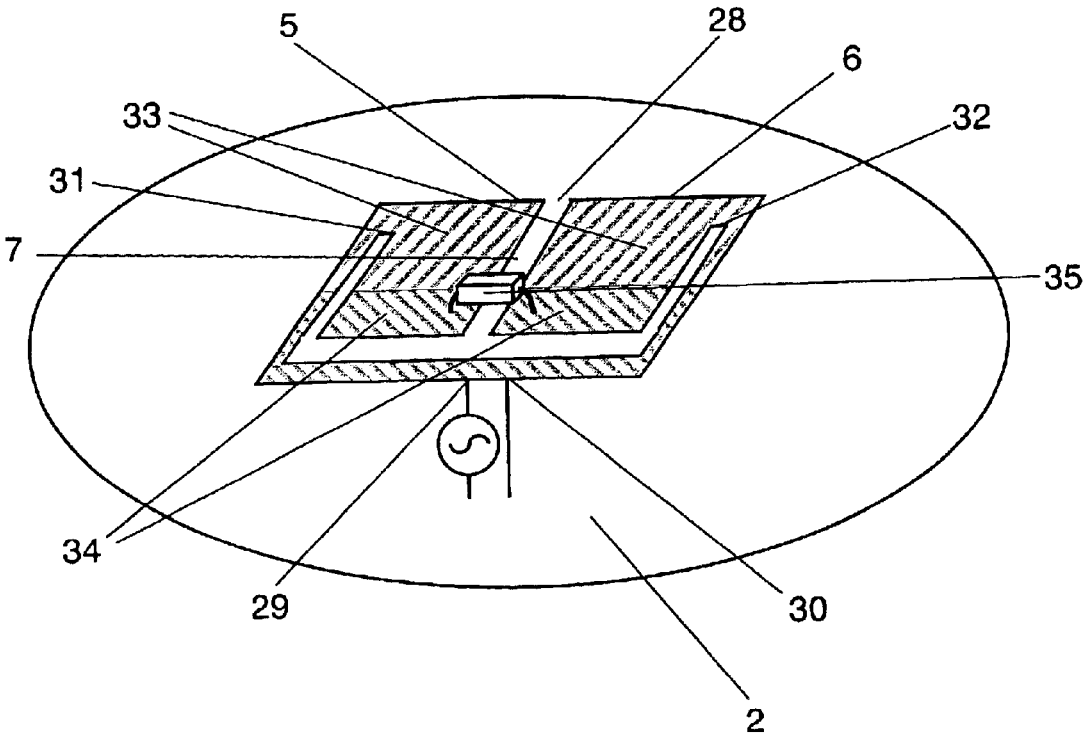
FIG. 20 is a perspective view of an antenna device in accordance with an eighteenth exemplary embodiment of the present invention.

FIG. 20 shows an antenna device in an eighteenth exemplary embodiment of the present invention.

In this embodiment, a slit provided on the radiating plate is branched to a T-shape about midway to form first and second slits. Each slit is bent approximately perpendicularly at near the end of the radiating plate, as shown in FIG. 20, and has end points 31 and 32. The radiating plate is divided into two areas by the perpendicular bisector to the line from start point 28 of the slit to feeding contact point 29 on the radiating plate.

These areas where start point 28 and feeding contact point 29 are present are called first area 33 and second area 34 respectively.

When end points 31 and 32 of first and second slits are present in the first area, a high-frequency potential of the radiating plate against grounding plate 2 is higher in second area 34 than in first area 33. Accordingly, a preferred antenna characteristic is achievable with a further smaller capacitance by loading capacitance element 35 in area 34.

Nineteenth Exemplary Embodiment

Figure 21:
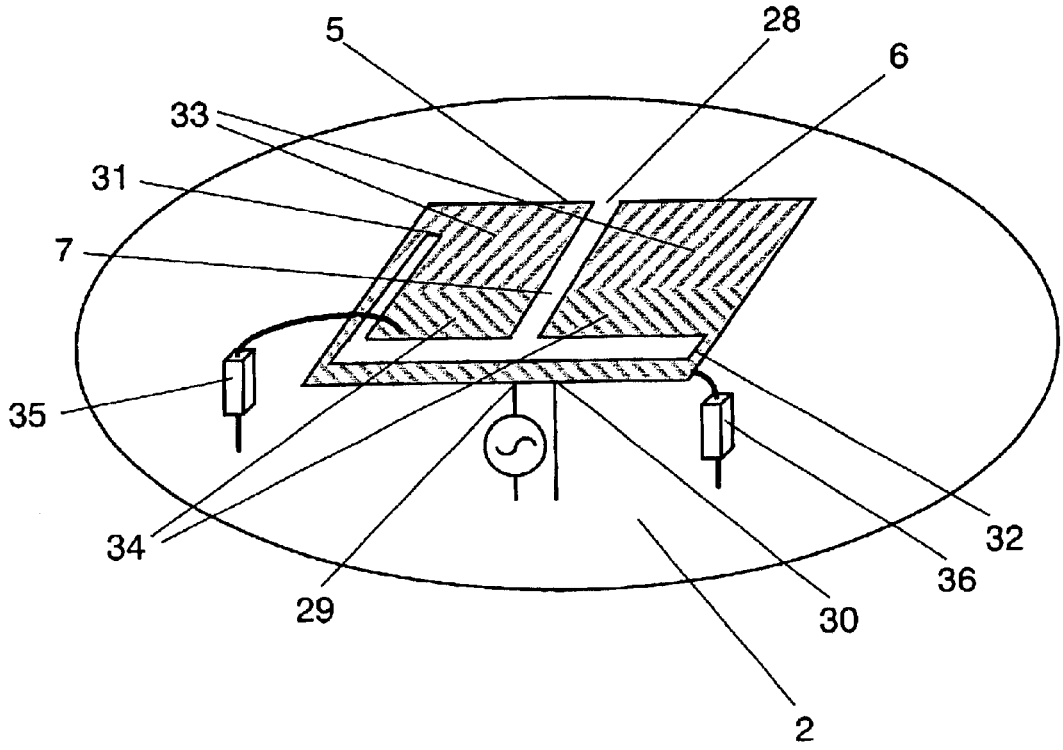
FIG. 21 is a perspective view of an antenna device in accordance with a nineteenth exemplary embodiment of the present invention.

FIG. 21 shows an antenna device in a nineteenth exemplary embodiment of the present invention.

In this embodiment, slit 7 provided on the radiating plate is branched to a T-shape about midway to form first and second slits. These first and second slits have end points 31 and 32. In addition, only one end of the slit bends approximately perpendicularly, as shown in FIG. 21, at near the end of the radiating plate.

The radiating plate is divided into two areas by the perpendicular bisector to the line from start point 28 of slit 7 to feeding contact point 29 on the radiating plate. These areas where start point 28 and feeding contact point 29 lie are called first area 33 and second area 34 respectively.

In FIG. 21, end point 31 of first slit 1 is present in first area 33. In this case capacitance element 35 is loaded on second area 34 which has a higher high-frequency potential against grounding plate 2 on resonator 5. On the other hand, a high-frequency current on resonator 6 in second area 34 is higher because end point 32 of the second slit is present in second area 34. Accordingly, a preferred antenna characteristic is achievable by using a reactance element which has a further smaller circuit constant of element by loading inductance element 36 on second area 34.

Industrial Applicability

The antenna device of the present invention has a slit on the radiating element of the planar inverted-F antenna to form two resonance radiating elements. The radiating elements are coupled by this slit, and achieves a wide-band frequency characteristic by generating dual resonance. This enables to realize a small, short, and wide-band antenna device. Furthermore, this antenna device has diversifying options to adjust antenna characteristics. Accordingly, the antenna device can be built in a range of communication apparatuses readily and flexibly.

What is claimed is:

1. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, and wherein a conductive coupling plate is provided near said radiating plate, via an insulating member, across said slit.

2. The antenna device as defined in claim 1, wherein said slit is one of a rough T-shape and tongue shape.

3. The antenna device as defined in claim 1, wherein a coupling level between said two resonators is adjusted by partially changing a width of said slit.

4. The antenna device as defined in claim 1, wherein a coupling level of said two resonators is adjusted by partially changing the size of said coupling plate.

5. The antenna device as defined in claim 1, wherein a part of said slit is progressively made longer to decrease a resonance frequency of said resonator.

6. The antenna device as defined in claim 1, wherein said radiating plate and said grounding plate are formed on a surface of one of dielectric, magnetic substance, and a mixture of dielectric and magnetic substance.

7. The antenna device as defined in claim 1, wherein a space exists between said radiating plate and said grounding plate.

8. The antenna device as defined in claim 1, wherein a reactance element is one of added to and formed on between said grounding plate and a part of at least one of said two resonators.

9. The antenna device as defined in claim 8, wherein said reactance element is formed by at least one of a coupling plate, comb element, microstrip line, chip capacitor, and chip inductor.

10. The antenna device as defined in claim 1, wherein a reactance element is one of added to and formed on a part of said slit.

11. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein a coupling level between said two resonators is adjusted by partially changing a width of said slit, and wherein a coupling plate and at least one of said two resonators are shorted.

12. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein a reactance element is one of added to and formed on between said grounding plate and a part of at least one of said two resonators, wherein said reactance element is formed by at least one of a coupling plate, comb element, microstrip line, chip capacitor, and chip inductor, and wherein a capacitance of said element is adjusted by changing a teeth shape of said element.

13. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, and wherein said slit is branched to a rough T-shape about midway, and at least one of said two resonators includes at least one of;

a capacitance element one of added to and formed on an area where a high-frequency electric field is dominant; and an inductance element one of added to and formed on an area where a high-frequency magnetic field is dominant.

14. The antenna device as defined in claim 13, wherein at least one of a capacitance element and an inductance element is one of added to and formed on at least one of between said slits and between said radiating plate and said grounding plate.

15. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said slit is branched to a rough T-shape about midway, and at least one of these branched slits is bent approximately perpendicularly at near a side of said radiating plate toward a start point of said slit, and at least one of said two resonators includes at least one of;

a capacitance element one of add to and formed on an area where a high-frequency electric field is dominant; and an inductance element one of added to and formed on an area where a high-frequency magnetic field is dominant.

16. The antenna device as defined in claim 15, wherein at least one of a capacitance element and an inductance element is one of added to and formed on at least one of between said slits and between said radiating plate and said grounding plate.

17. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein;

said radiating plate is divided into two areas by a rough perpendicular bisector to a line from a point where said shorting portion is provided (shorting point) and a start point of said slit, said two areas being an area where said start point is present (first area) and an area where said shorting point is present (second area); and when an end point of said slit lies on said second area;

a capacitance element is one of added to and formed on said first area; and an inductance element is one of added to and formed on said second area.

18. The antenna device as defined in claim 17, wherein at least one of a capacitance element and an inductance element is one of added to and formed on at least one of between said slits and between said radiating plate and said grounding plate.

19. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said radiating plate is divided into two areas by a rough perpendicular bisector to a line from a point where said shorting portion is provided (shorting point) and a start point of said slit, said two areas being an area where said start point is present (first area) and an area where said shorting point is present (second area); and a capacitance element is one of added to and formed on said second area when said slit is progressively made longer passing through said second area and its end point of the slit is present in said first area.

20. The antenna device as defined in claim 19, wherein at least one of a capacitance element and an inductance element is one of added to and formed on at least one of between said slits and between said radiating plate and said grounding plate.

21. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said radiating plate is divided into two areas by a rough perpendicular bisector to a line from a point where said feeding line is provided (feeding point) and a start point of said slit, said two areas being an area where said start point is present (first area) and an area where said feeding point is present (second area); and when an end point of said slit lies on said second area;

a capacitance element is one of added to and formed on said first area; and an inductance element is one of added to and formed on said second area.

22. The antenna device as defined in claim 21, wherein at least one of a capacitance element and an inductance element is one of added to and formed on at least one of between said slits and between said radiating plate and said grounding plate.

23. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said radiating plate is divided into two areas by a rough perpendicular bisector to a line from a point where said feeding line is provided (feeding point) and a start point of said slit, said two areas being an area where said start point is present (first area) and an area where said feeding point is present (second area); and a capacitance element is one of added to and formed on said second area when said slit is progressively made longer passing through said second area and an end point of the slit is present in said first area.

24. The antenna device as defined in claim 23, wherein at least one of a capacitance element and an inductance element is one of added to and formed on at least one of between said slits and between said radiating plate and said grounding plate.

25. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said slit is branched to said first resonator side and said second resonator side about midway as a first slit and a second slit, and said radiating plate is divided into two areas by a perpendicular bisector to a line from a point where a shorting portion is provided (shorting point) on said radiating plate and a start point of said slit, said areas being an area where said start point is present (first area) and an area where said shorting point is present (second area);

when an end point of said first slit lies on said second area, said first resonator has;

a capacitance element is one of added to and formed on said first area; and an inductance element one of added to and formed on said second area in said first resonator; and when said second slit passes through said second area and an end point of said second slit lies on said first area, said second resonator has;

a capacitance element one of added to and formed on said second area in said second resonator.

26. The antenna device as defined in claim 25, wherein at least one of a capacitance element and an inductance element is one of added to and formed on at least one of between said slits and between said radiating plate and said grounding plate.

27. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said slit is branched to said first resonator side and said second resonator side about midway as a first slit and a second slit, and said radiating plate is divided into two areas by a perpendicular bisector to a line from a point where a feeding line is provided (feeding point) on said radiating plate and a start point of said slit, said areas being an area where said start point is present (first area) and an area where said feeding point is present (second area);

when an end point of said first slit lies on said second area, said first resonator has;

an capacitance element is one of added to and formed on said first area; and an inductance element is one of added to and formed on said second area in said first resonator; and when said second slit passes through said second area and an end point of said second slit lies on said first area, said second resonator has;

a capacitance element is one of added to and formed on said second area in said second resonator.

28. The antenna device as defined in claim 27, wherein at least one of a capacitance element and an inductance element is one of added to and formed on at least one of between said slits and between said radiating plate and said grounding plate.

29. An antenna device comprising:

a radiating plate;

a feeding line provided to one of a side and an end of said radiating plate;

a grounding plate provided facing said radiating plate; and a shorting portion whose one end is disposed near said feeding line and an other end is connected to said grounding plate;

wherein two resonators including a first resonator and a second resonator are formed on said radiating plate by providing a slit on a side face or an end face of said radiating plate approximately opposing said feeding line, and said antenna device has an wide band frequency range responsive to a coupling level between said two resonators, wherein said resonators have a meander shape.

* * * * *